US011517112B2

(12) United States Patent
Zhou et al.

(10) Patent No.: US 11,517,112 B2
(45) Date of Patent: Dec. 6, 2022

(54) CAM ADJUSTMENT DEVICE FOR LIFTING AND LOWERING ARMREST AND CHAIR HAVING THE SAME

(71) Applicant: ZHEJIANG MOTOSTUHL FURNITURE CO., LTD, Zhejiang (CN)

(72) Inventors: Jun Zhou, Zhejiang (CN); Daqiu Wang, Zhejiang (CN)

(73) Assignee: ZHEJIANG MOTOSTUHL FURNITURE CO., LTD, Zhejiang (CN)

( * ) Notice: Subject to any disclaimer, the term of this patent is extended or adjusted under 35 U.S.C. 154(b) by 0 days.

(21) Appl. No.: 17/228,608

(22) Filed: Apr. 12, 2021

(65) Prior Publication Data

US 2022/0175142 A1 Jun. 9, 2022

(30) Foreign Application Priority Data

Dec. 8, 2020 (CN) ..... 202022922846.4

(51) Int. Cl.
*A47C 7/54* (2006.01)
*A47C 1/03* (2006.01)

(52) U.S. Cl.
CPC ..... *A47C 7/541* (2018.08); *A47C 1/0303* (2018.08)

(58) Field of Classification Search
CPC ..... A47C 7/402; A47C 1/03; A47C 7/541; A47C 1/0303
USPC ..... 297/411.36
See application file for complete search history.

(56) References Cited

U.S. PATENT DOCUMENTS 5,620,233 A * 4/1997 Corwin ..... A47C 7/402 297/411.36
5,725,278 A * 3/1998 Verbeek ..... A47C 7/402 297/353
7,708,251 B2 * 5/2010 Watt ..... B62K 19/36 248/407
2003/0178882 A1 * 9/2003 Schmitz ..... A47C 1/03266 297/411.36

* cited by examiner

*Primary Examiner* — Sarah B McPartlin
(74) *Attorney, Agent, or Firm* — JCIPRNET

(57) ABSTRACT

A cam adjustment device for lifting and lowering an armrest includes an armrest assembly and a support frame. The armrest assembly includes a connection base. The support frame has a support rod. The connection base is slidably connected to the support rod. A locking mechanism includes a cam wrench disposed on the connection base and rotatably installed on the connection base. The cam wrench is rotated such that a cam on the cam wrench presses and acts on the support rod. In a locked state, the cam wrench presses the support rod such that the connection base and the support rod are kept to be relatively fixed. In an unlocked state, the cam wrench is rotated to allow the cam to be released from the support rod, such that the connection base is lifted, lowered, and adjusted relative to the support rod.

7 Claims, 12 Drawing Sheets

CAM ADJUSTMENT DEVICE FOR LIFTING AND LOWERING ARMREST AND CHAIR HAVING THE SAME

CROSS-REFERENCE TO RELATED APPLICATION

This application claims the priority benefit of China application serial no. 202022922846.4, filed on Dec. 8, 2020. The entirety of the above-mentioned patent application is hereby incorporated by reference herein and made a part of this specification.

BACKGROUND

Technical Field

The disclosure relates to the field of seats, and in particular, relates to a cam adjustment device for lifting and lowering an armrest and a chair having the same.

Description of Related Art

A chair is a seat with a backrest and armrests. Conventionally, the armrest height on a chair is fixed most of the time. Nevertheless, when a tall user seats on the chair and places the arms on the armrests, the user has to bend the body to be able to fully place the arms on the armrests. When a short user seats on the chair and places the arms on the armrests, the arms are raised. When the arms are kept in such a state for a long time, the arms may become numb. It thus can be seen that the use of such a chair may not be universally applied and is restricted. Therefore, some chair manufacturers have proposed the concept of research and development of devices for lifting, lowering, and adjusting armrests. The armrests of chairs are allowed to be adjusted according to actual needs of users, so that the use of chairs become universally applied, and a comfortable using experience is also provided.

At present, many types of lifting and lowering mechanisms for chair armrests may be found on the market. Nevertheless, each type of the lifting and lowering mechanisms for chair armrests has many internal parts, and the positional relationship and connection relationship among the parts are complicated. An armrest lifting and lowering structure may be designed to include a hollow tube-shaped support seat and an armrest main body arranged in the support seat and slidably matched with the support seat. An adjustment mechanism is disposed between the armrest main body and the support seat, and the height of the armrest main body may be adjusted through the adjustment mechanism. The support seat is connected to the chair seat. The height of the armrests may be adjusted in this way, but the structure of the armrests itself is excessively complicated because the structure is formed by many components. The internal structure is complicated as well because the adjustment mechanism not only needs to realize the lifting and lowering of the armrest main body but also needs to lock the armrest main body. It thus can be seen that the armrests may not be conveniently assembled, installed, and disassembled as a whole. High costs are thus required for armrest processing and installing. Design of an adjustment device with a simple structure, which is cost-saving and is convenient to manipulate, for lifting and lowering an armrest is an important issue.

SUMMARY

Aiming to overcome the shortcomings found in the related art, the disclosure provides a cam adjustment device for lifting and lowering an armrest capable of achieving lifting, lowering, and adjusting of an armrest through slidable connection between a connection base and a support rod. Further, a cam wrench is rotatably connected to the connection base. Sliding between the connection base and the support rod is locked or unlocked through rotating the cam wrench, and such a structure is simple and reliable, is cost-saving, and is convenient to manipulate because only the cam wrench is required to be rotated.

The disclosure further provides a chair, and the chair is provided with the cam adjustment device for lifting and lowering the armrest, so that lifting, lowering, and adjusting of armrests of the chair may be conveniently performed.

Technical solutions provided by the disclosure are implemented through the following manners.

A cam adjustment device for lifting and lowering an armrest includes an armrest assembly and a support frame configured to support the armrest assembly. The armrest assembly includes a connection base, the support frame has a support rod arranged in a longitudinal direction, and the connection base is slidably connected to the support rod. A locking mechanism is provided between the connection base and the support rod, the locking mechanism includes a cam wrench disposed on the connection base, and the cam wrench is rotatably installed on the connection base. The cam wrench is rotated such that a cam on the cam wrench directly or indirectly presses and acts on the support rod. The armrest assembly has a locked state and an unlocked state. In the locked state, the cam wrench presses and acts on the support rod such that the connection base and the support rod are kept to be relatively fixed. In the unlocked state, the cam wrench is rotated to allow the cam to be released from the support rod such that the connection base is lifted, lowered, and adjusted relative to the support rod.

A chair includes a chair seat and the cam adjustment device for lifting and lowering the armrest. The support frame is installed on the chair seat.

The disclosure adopting the above technical solutions exhibits the following design starting point, concepts, and beneficial effects.

First, the connection base is slidably connected to the support rod, so the connection base is able to be controlled to be lifted and lowered along the support rod, and the armrest may thus be accordingly lifted and lowered. A locking mechanism is designed and provided between the connection base and the support rod, and the locking mechanism includes a cam wrench rotatably connected to the connection base. In this way, the cam wrench is able to press and act on the support rod through rotating the cam wrench, and the support rod is able to thus be kept to be relatively fixed to the connection base. Sliding between the connection base and the support rod may be directly locked or unlocked through controlling the cam wrench only, and such a structure is simple and is convenient to manipulate.

Further, in order to allow the cam wrench to provide a favorable locking effect, the elastic engagement member or the locking plate which is able to be engaged and matched with the support rod is arranged between the cam wrench and the support rod. As such, in the locked state, the cam wrench may press and act on the elastic engagement member or the locking plate, so that the two are engaged and matched with the support rod. In this way, locking is securely performed, and a favorable locking effect is provided.

Further, regardless of whether the elastic engagement member or the locking plate is adopted, the elastic reset device or the elastic element is arranged between the elastic engagement member and the support rod, and the elastic element is arranged between the locking plate and the support rod. In this way, when the cam wrench is controlled to allow the armrest assembly to be switched from the locked state to the unlocked state, both the elastic engagement member and the locking plate is able to be automatically and elastically reset and is able to be separated from and disengaged with the support rod. As such, manipulation may be smoothly performed, and a favorable damping feeling is provided when rotating the cam wrench.

Second, the support rod is provided with the sliding base. The sliding base is provided with the sliding path, and the sliding rail is correspondingly disposed on the connection base. The sliding path is slidably matched with the sliding rail, so that the connection base may stably and smoothly slide relative to the support rod, and oscillation may also be eliminated. Alternatively, the guide posts and the guide grooves are disposed between the connection base and the support rod, and stable sliding between the connection base and the support rod may also be achieved in this way. Both the sliding manners allows sliding between the connection base and the support rod to be stable. Further, in the armrest assembly, the cam wrench covers on the connection base in the locked state, and a compact and appealing structure is thereby provided.

DESCRIPTION OF THE EMBODIMENTS

Figure 1:
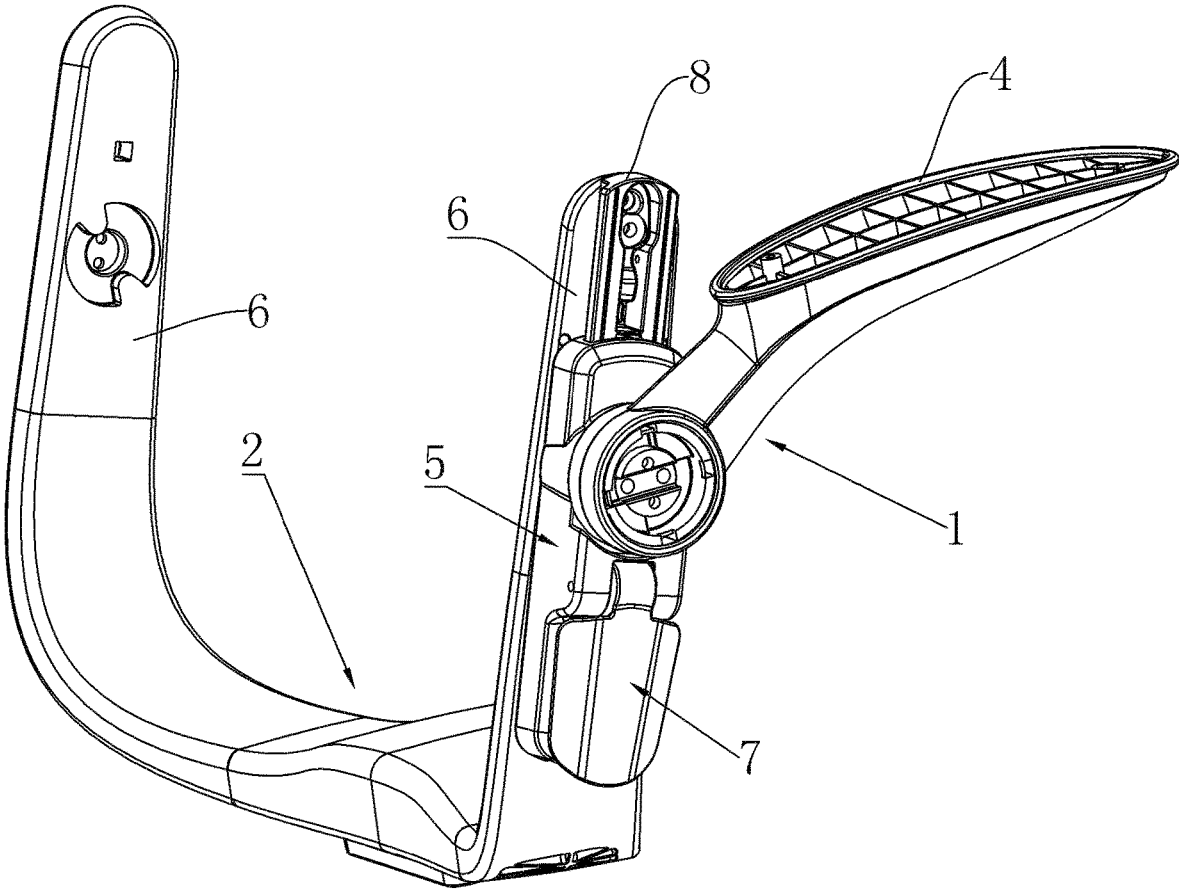
FIG. 1 is a schematic view of a three-dimensional structure of a connection base connected to a support frame according to Embodiment 1 of the disclosure.

To better illustrate the above objectives, features, and advantages of the disclosure, the disclosure is further described in detail below in combination with the accompanying drawings and specific embodiments. Note that the embodiments of the disclosure and the features in the embodiments may be combined with each other with no absence of conflict.

In the description provided as follows, many specific details are explained in order to fully understand the disclosure. However, the disclosure may also be implemented in other ways different from those described herein. Therefore, the protection scope of the disclosure is not limited by the specific embodiments disclosed below.

In the description of the disclosure, the term "at least one" refers to one or more than one unless specifically defined otherwise. The terms "first", "second", "third", etc. are only used for descriptive purposes and cannot be understood as indicating or implying relative importance.

This embodiment relates to the reference orientation of each part, such as front and back, and is described in a state where the chair is normally used after a user sits down.

Specific embodiments of the disclosure are provided as follows.

Embodiment 1. As shown in FIG. 1 to FIG. 8, the disclosure provides a cam adjustment device for lifting and lowering an armrest. The cam adjustment device for lifting and lowering the armrest includes an armrest assembly 1 and a support frame 2 configured to support the armrest assembly 1, and the support frame 2 is connected to a chair seat 3 of a chair. The armrest assembly 1 includes an armrest 4 and a connection base 5. An upper end of an outer side of the connection base 5 is provided with a connection shaft (a) configured for installation of the armrest 4, and the armrest 4 is rotatably connected to the connection shaft (a). The support frame 2 has a support rod 6 disposed in a longitudinal direction, and the connection base 5 is slidably connected to an outer side of the support rod 6. As such, the connection base 5 is able to move up and down along the support rod 6 to adjust a height of the armrest 4. A locking mechanism is further provided between the connection base 5 and the support rod 6. The locking mechanism includes a cam wrench 7 convenient for manual manipulation, and the connection base 5 is able to be slidably locked and unlocked through rotation of the cam wrench 7. In this way, the armrest 4 is able to be lifted, lowered, locked, and unlocked. Such a structure is simple, reliable, and convenient to manipulate.

Figure 2:
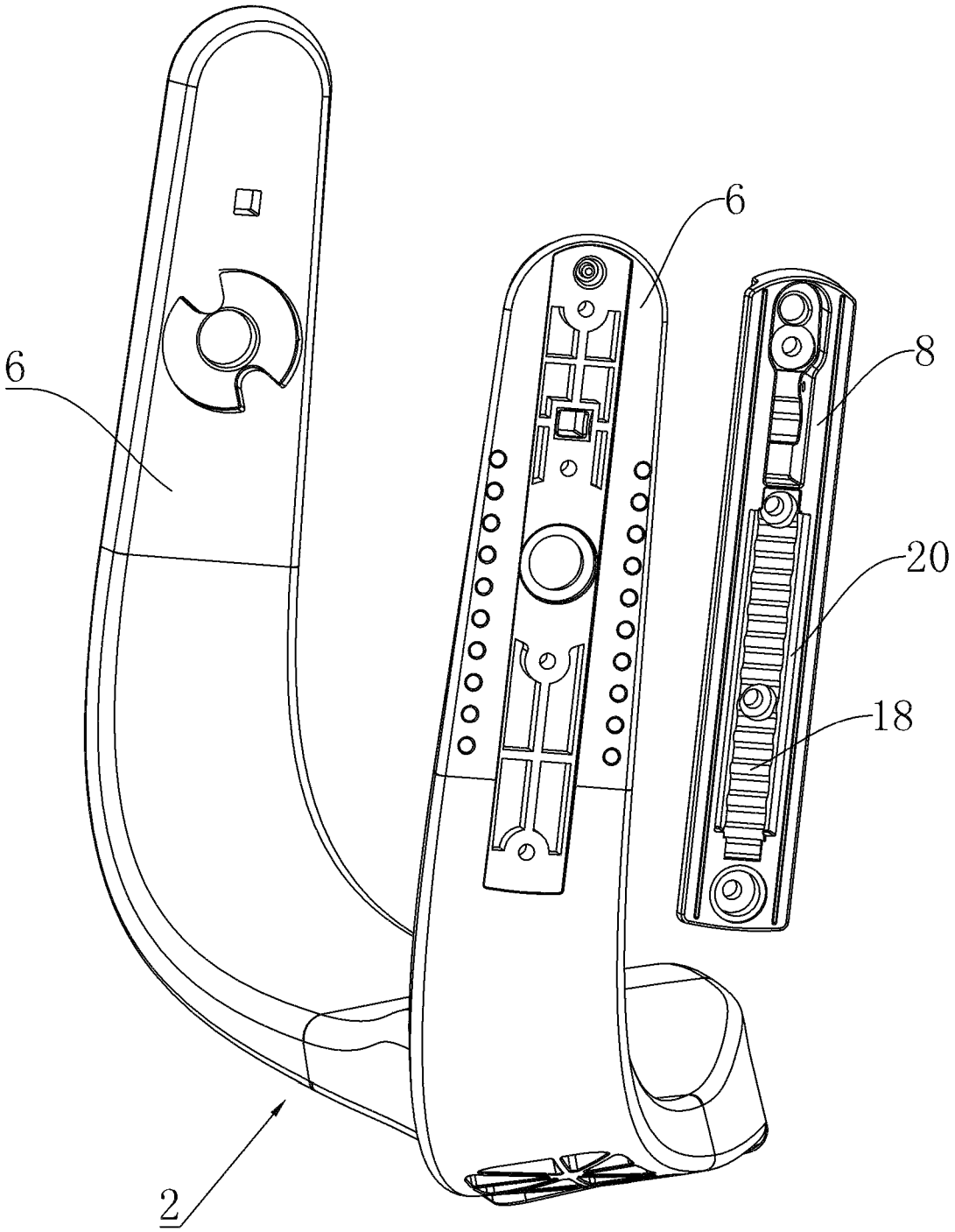
FIG. 2 is a schematic view of a three-dimensional structure of the support frame according to Embodiment 1 of the disclosure.
Figure 3:
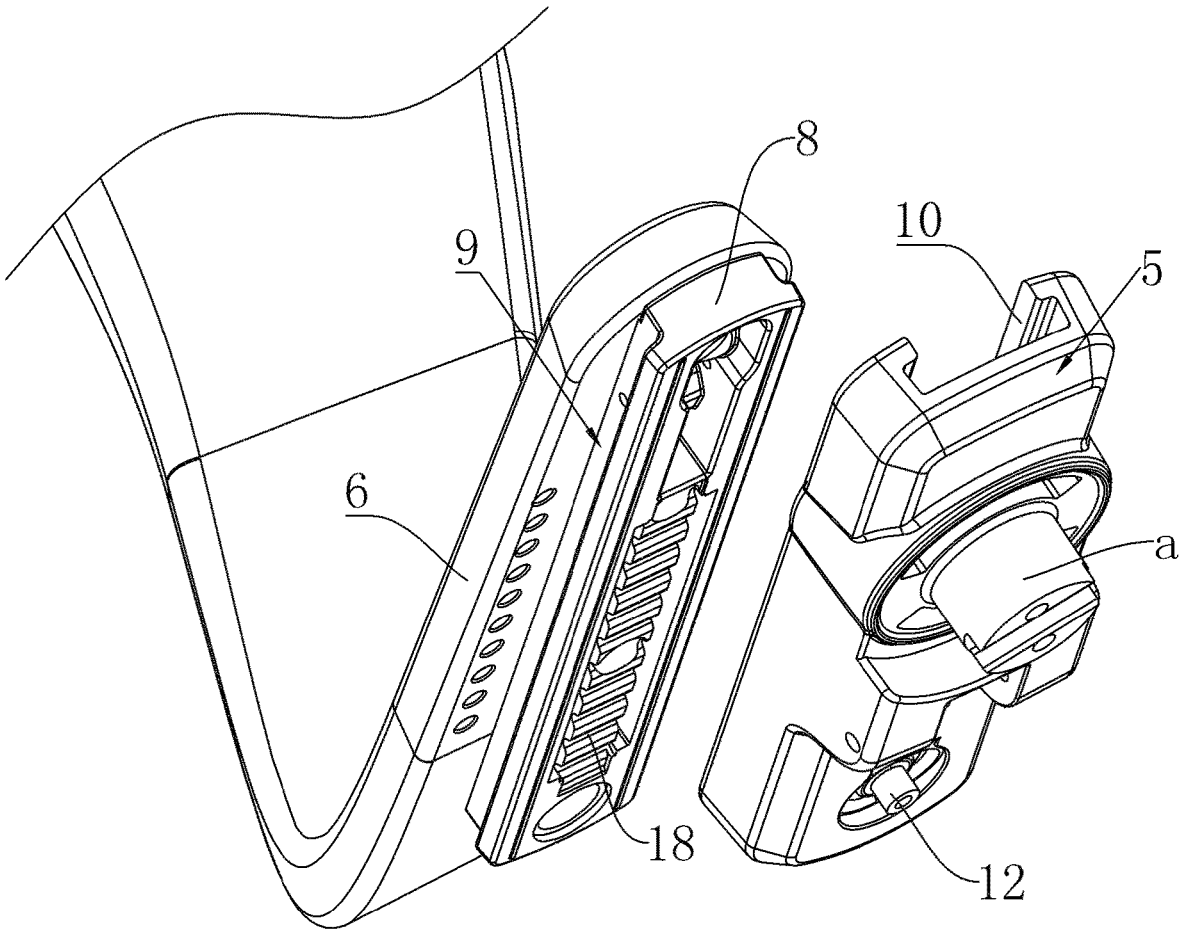
FIG. 3 is a schematic view of a three-dimensional structure of the connection base slidably connected to a support rod according to Embodiment 1 of the disclosure.

As shown in FIG. 1 to FIG. 3, an outer side surface of the support rod 6 is provided with a sliding base 8 slidably matched with the connection base 5. The sliding base 8 is connected and fixed to the support rod 6 through screws, and the sliding base 8 is disposed in a length direction of the support rod 6. The sliding base 8 is slidably matched with the connection base 5 in the following manner. A sliding guide mechanism is provided between the sliding base 8 and the connection base 5, and the sliding guide mechanism includes a sliding path 9 disposed on two sides of the sliding base 8 and a sliding rail 10 correspondingly disposed on two sides of the connection base 5. To be specific, the sliding base 8 outwardly protrudes from the support rod 6, and a width of the sliding base 8 is less than a width of the support rod 6. In a width direction of the sliding base 8, two sides of the sliding base 8 are recessed inwards to form the sliding path 9 extending in a length direction of the sliding base 8. Correspondingly, one side of the connection base 5 facing the support rod 5 is a hollow structure. Two sides of the connection base 5 close to the sliding base 8 respectively extend towards a middle portion of the connection base 5 to form the sliding rail 10 also extending in a length direction of the connection base 5. As such, when connection is required, the sliding rail 10 on the connecting base 5 may slide from top to bottom into the sliding path 9 on the sliding base 5, and the connection base 5 is slidably matched with the sliding base 8 is this way. As such, the connection base 5 is restricted to slide only in the length direction of the sliding base 8, and the connection base 5 and the sliding base 8 are relatively fixed in a left-right direction.

As shown in FIG. 4 to FIG. 8, the locking mechanism further includes an elastic engagement member 11 connected to the connection base 5. The elastic engagement member 5 has a long strip shape. The elastic engagement member 11 is elastic and includes an engagement head 11*a* located on an upper end thereof, a connection portion 11*b* located on a lower end thereof, and a connection rod 11*c* connected to the engagement head 11*a* and the connection portion 11*b*. The connection rod 11*c* is elastic, and the connection rod 11*c* has a bent section in the middle, so that the engagement head 11*a* and the connection portion 11*b* are staggered left and right. A lower end of one side of the connection base 5 away from the support rod 6 is correspondingly provided with a fixing portion 12, and a middle portion of the connection base 5 is provided with a rotation installation groove 13 penetrating left and right. As such, when the elastic engagement member 11 is connected, the engagement head 11*a* located on the upper end penetrates through the rotation installation groove 13, and the connection portion 11*b* located on the lower end is connected and fixed to the fixing portion 12 on the connection base 5 through screws. The lower end of the elastic engagement member 11 is thereby fixed to the connection base 5, and the elastic engagement member 11 may thus be bent and deformed within a certain range so that the engagement head 11*a* may move in the left-right direction relative to the connecting base 5. Further, an elastic reset device is further provided between the elastic engagement member 11 and the connection base 5, and the elastic reset device includes a spring 14. A spring installation hole 15 is provided on the connection base 5. A height of the spring installation hole 15 is located between the fixing portion 12 and the rotation installation groove 13. A matching portion 16 matched with installation of the spring 14 is correspondingly disposed on the connection rod 11*c* of the elastic engagement member 11. One end of the spring 14 is installed in the spring installation hole 15, and the other end of the spring 14 is connected to and matched with the matching portion 16. As such, when the engagement head 11*a* is acted upon by an external force and moves towards the support rod 6, the spring 18 is elastically compressed to provide an elastic force for the elastic engagement member 10 to reset, so the engagement head 10*a* is inclined to move away from the support rod 6.

Figure 4:
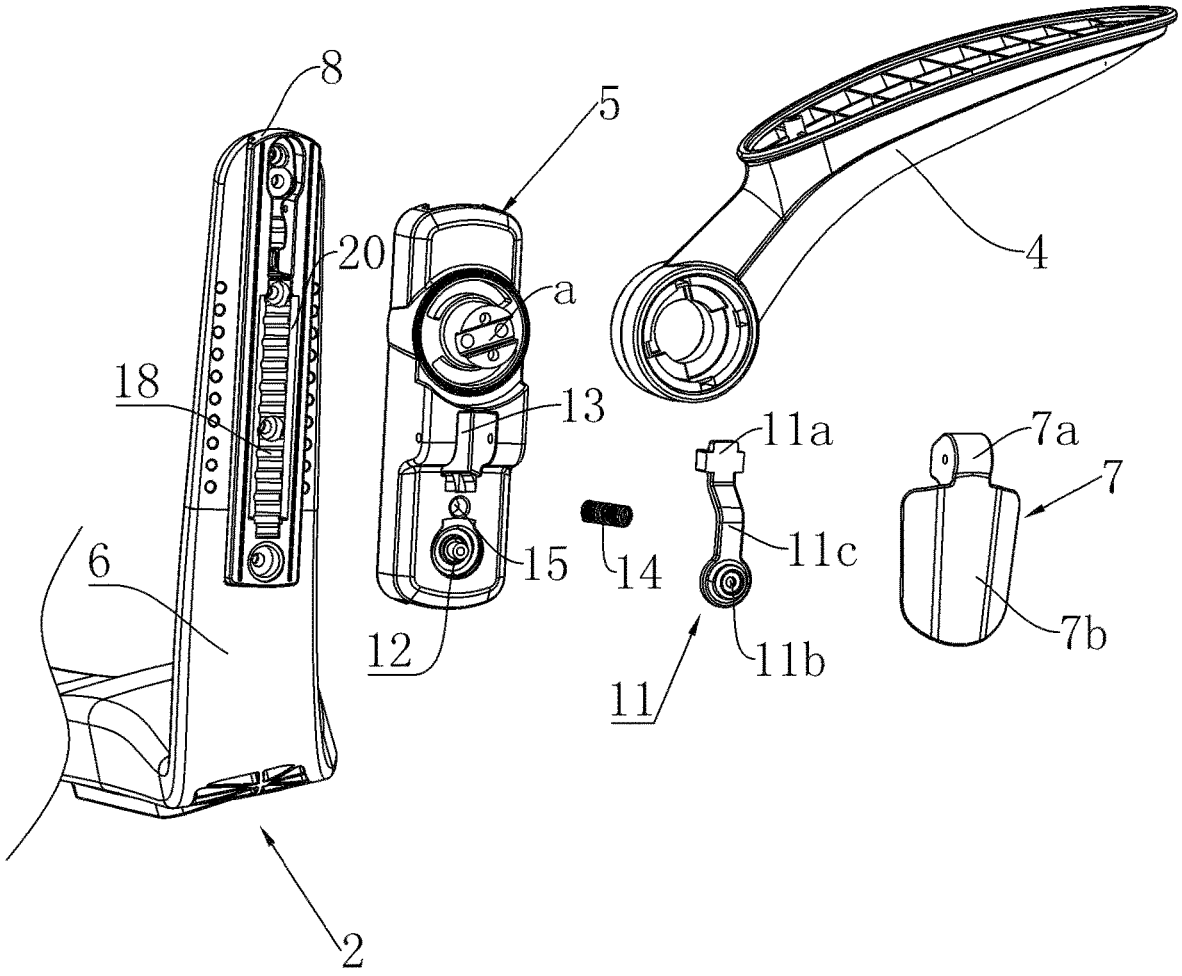
FIG. 4 is an exploded view of the connection base connected to the support rod according to Embodiment 1 of the disclosure.
Figure 5:
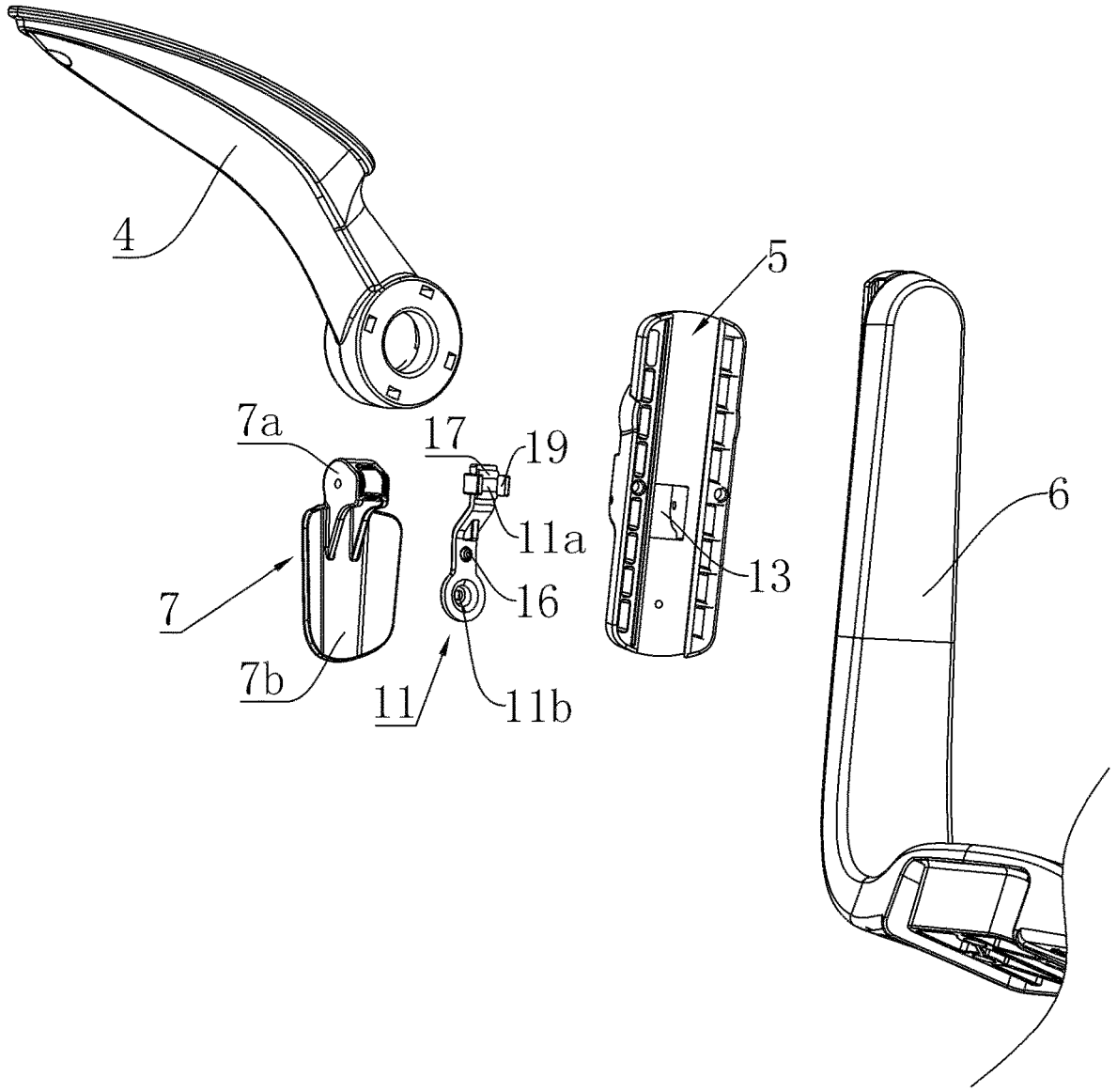
FIG. 5 is an exploded view of the connection base connected to the support rod at another angle according to Embodiment 1 of the disclosure.

During installation, the elastic engagement member 11 is connected to the connection base 5 first, and the connection base 5 is then slidably matched with the support rod 6. As such, the engagement head 11*a* is clamped between the sliding base 8 and the connection base 5. Engagement teeth 17 and engagement grooves 18 engaged and matched with each other are provided between the engagement head 11*a* and the sliding base 8. To be specific, an end surface of the engagement head 11*a* facing the support rod 6 is provided with two engagement teeth 17 which are arranged at intervals in the longitudinal direction, and the engagement teeth 17 protrude from the end surface of the engagement head 11*a*. One side of the sliding base 8 facing the connection base 5 is correspondingly provided with the plurality of engagement grooves 18. The engagement grooves 18 are longitudinally arranged on the sliding base 8 at intervals in a wavy shape. The engagement teeth 17 may be engaged and matched with the engagement grooves 18. As such, when the engagement head 11*a* and the sliding base 8 are close together, the engagement teeth 17 are engaged with the engagement grooves 18, and the connection base 5 is relatively fixed to the support rod 6. When the engagement head 11*a* is separated from the support rod 6, the engagement teeth 17 are disengaged from the engagement grooves 18, and the connection base 5 is able to slide up and down relative to the support rod 6 to adjust the height of the armrest 4. That is, sliding of the connection base 5 may be locked and unlocked through control of movement of the engagement head 11*a*. In addition, note that after installation is completed, when the elastic engagement member 11 is not acted upon by an external force, the engagement head 11*a* is not attached to the sliding base 8 in a free state, and a gap is certainly provided therebetween. That is, the engagement teeth 17 are not engaged with the engagement grooves 18. In this state, the connection base 5 may slide relative to the support rod 6. In addition, as shown in FIG. 4 and FIG. 5, guide blocks 19 facing towards the support rod 6 are disposed on left and right ends of the engagement head 11*a*, the engagement teeth 17 are located between the two guide blocks 19, and a length of each of the guide blocks 19 is greater than a length of each of the engagement teeth 17. Two sliding grooves 20 are correspondingly disposed in the length direction of the sliding base 8, and the engagement groove 18 is also located between the two sliding grooves 20. After the support rod 6 is connected to the connection base 5, the guide blocks 19 are always slidably matched in the sliding grooves 20. As such, the engagement head 11*a* is prevented from shifting back and forth, and the engagement head 11*a* slides in the length direction of the support rod 6 as well when the sliding base 5 slides, so sliding is performed stably, and a stable internal structure is provided. Further, since the sliding grooves 20 have certain lengths, the guide blocks 19 are restricted to only move inside the sliding grooves 20, and sliding between the connection base 5 and the sliding base 8 is limited. As such, the connection base 5 is prevented from sliding out of the support rod 6, and a designed structure which is simple and reliable is thereby provided.

Figure 6:
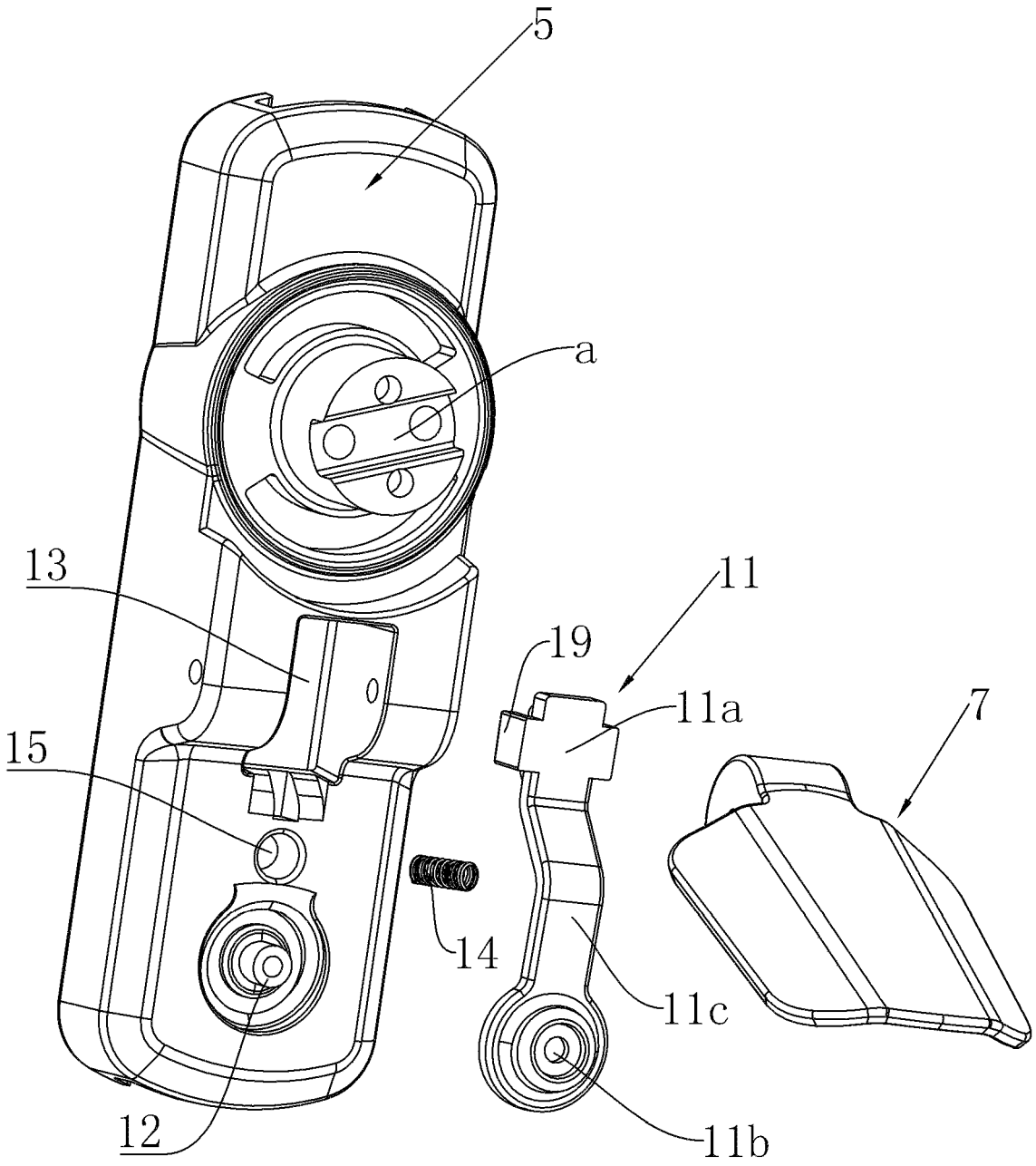
FIG. 6 is a schematic view of a three-dimensional structure of an elastic engagement member connected to the connection base according to Embodiment 1 of the disclosure.
Figure 7:
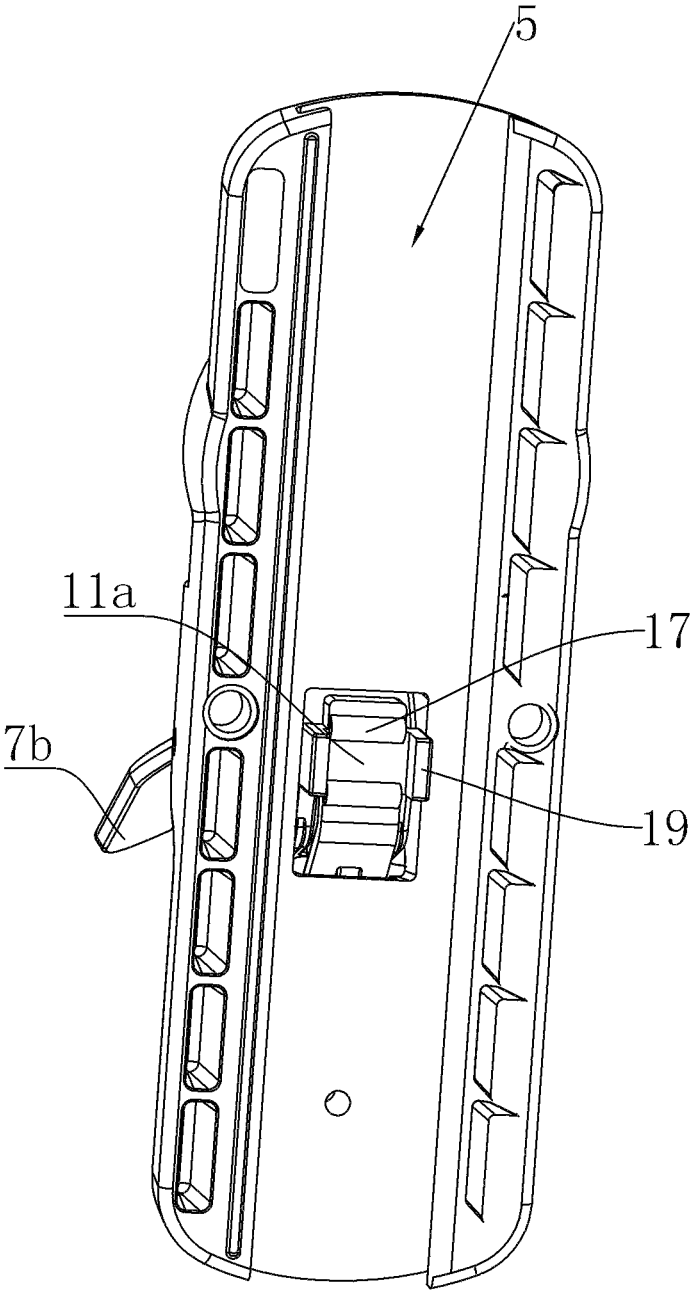
FIG. 7 is a schematic view of a three-dimensional structure of the elastic engagement member after being connected to the connection base according to Embodiment 1 of the disclosure.
Figure 8:
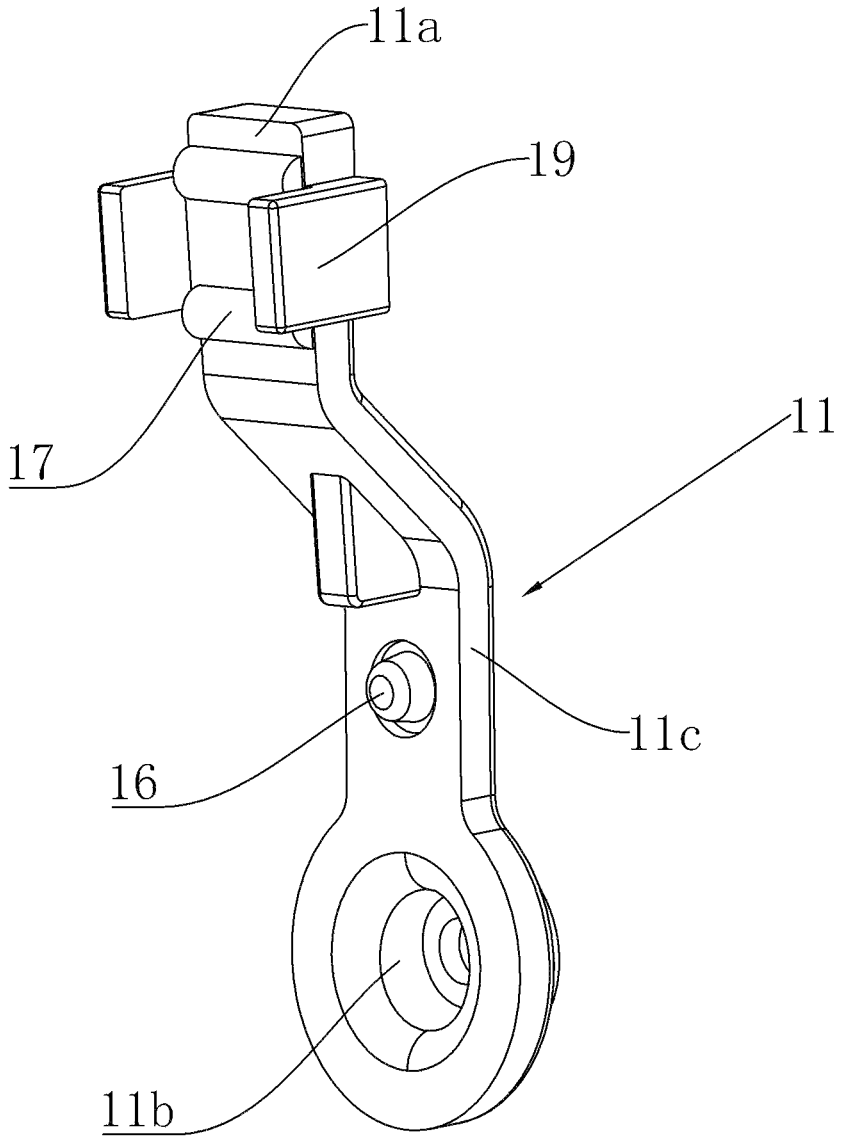
FIG. 8 is a schematic view of a three-dimensional structure of the elastic engagement member according to Embodiment 1 of the disclosure.

As shown in FIG. 4 to FIG. 6, after the cam wrench 7 is rotatably connected to the connection base 5, the cam wrench 7 is rotatable to drive the engagement head 11*a* to move left and right to control the engagement teeth 17 to be engaged with the engagement grooves 18. To be specific, the cam wrench 7 has a cam 7*a* and a handle 7*b* driving the cam 7*a* to rotate. The cam 7*a* is rotatably connected in the rotation installation groove 13 on the connection base 5, and the handle 7*b* is exposed outside the connection base 5. Since the rotation installation groove 12 penetrates through the connection base 5, that is, an inclined surface of the cam 7*a* directly abuts against the engagement head 11*a*, control of rotation of the cam 7*a* may directly push the engagement head 11*a* to move towards the support rod 6. As such, the engagement head 11*a* is attached to the sliding base 8, and the engagement teeth 17 are engaged and matched with the engagement grooves 18. In this way, sliding between the connection base 5 and the support rod 6 is locked. In such a locked state, the handle 7*b* covers on the connection base 5, and a compact and appealing structure is thereby provided. When sliding is required to be unlocked, the handle 7*b* is required to be flipped outwards only. The engagement head 11*a* moves away from the sliding base 8 under an elastic force of the spring 14, so that the engagement teeth 17 are separated from the engagement grooves 18. The connection base 5 may thereby slide up and down relative to the support rod 6 to adjust the height of the armrest 4. After adjustment is completed, the handle 7*b* is rotated downwards, the cam wrench 7 presses the engagement head 11*a* again so that the engagement head 11*a* is locked with the support rod 6, and the connection base 5 is relatively fixed to the support rod 6 again.

Embodiment 2. A difference between this embodiment and Embodiment 1 is that, the locking mechanism further includes a locking plate 21 movably connected between the connection base 5 and the support rod 6, and the locking plate 21 may be engaged and matched with the support rod 6. The cam wrench 7 acts on the locking plate 21 to achieve locking and unlocking of sliding between the connection base 5 and the support rod 6.

Figure 9:
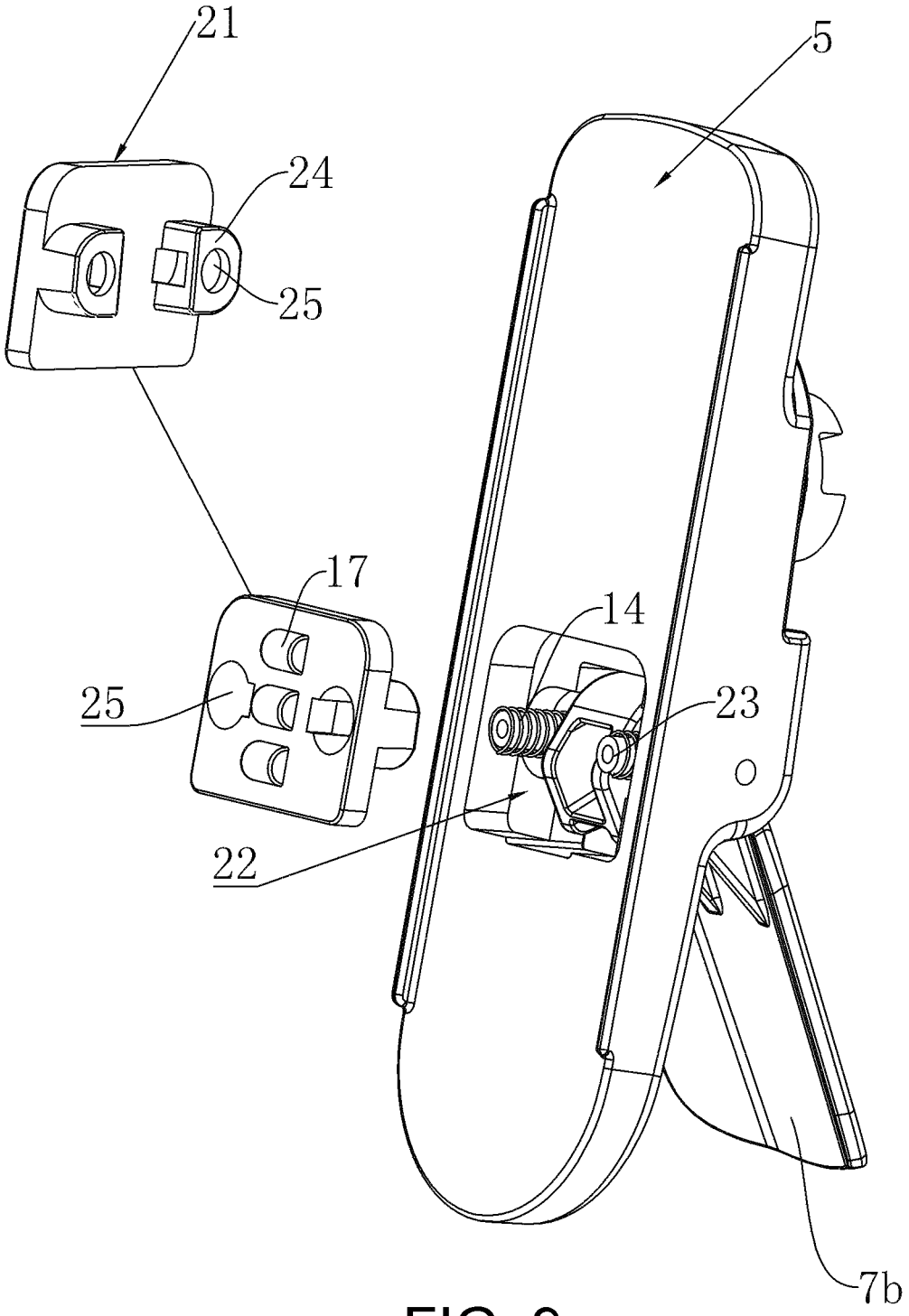
FIG. 9 is a schematic view of a three-dimensional structure of a locking plate installed to the connection base according to Embodiment 2 of the disclosure.
Figure 10:
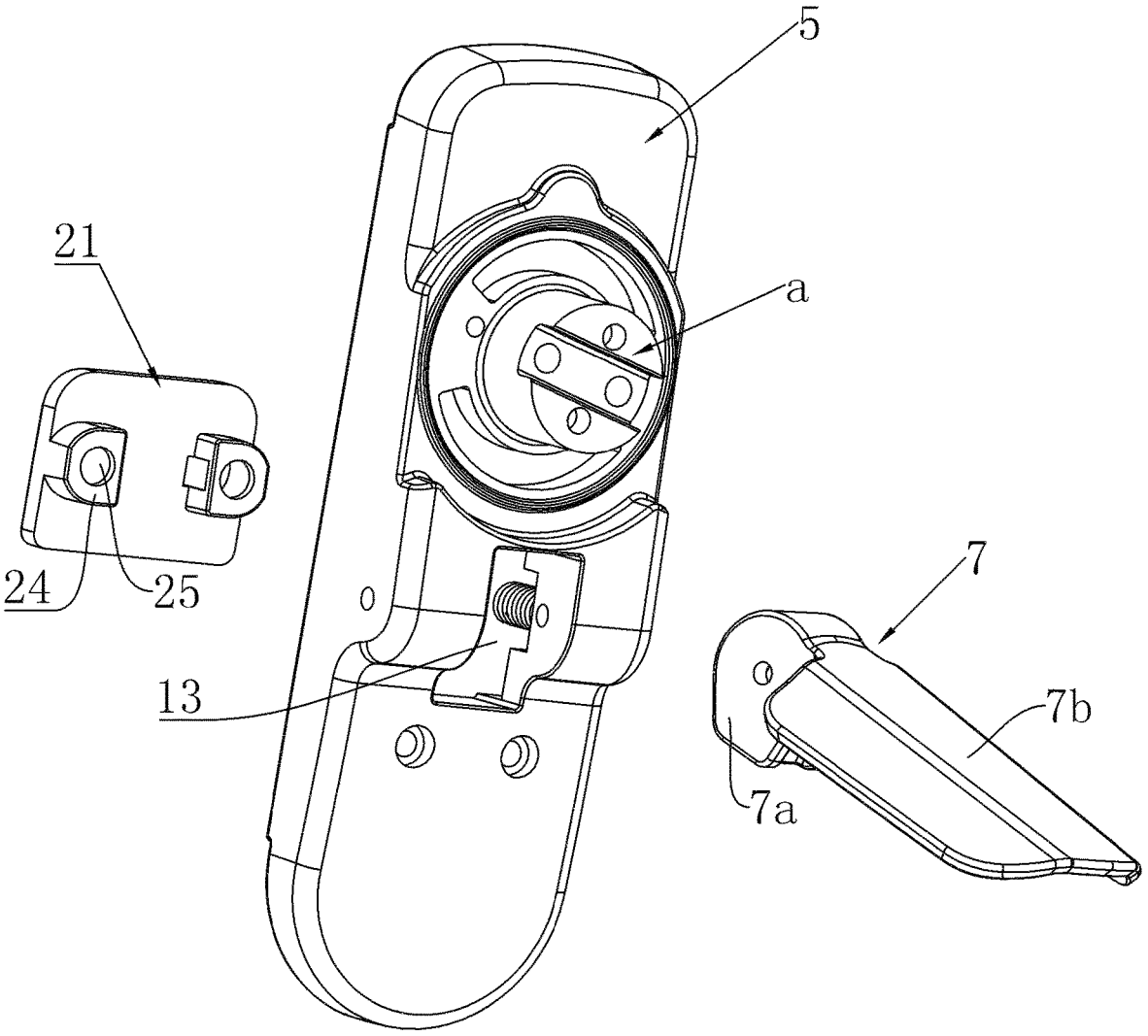
FIG. 10 is a schematic view of a three-dimensional structure of a cam wrench connected to and matched with the locking plate according to Embodiment 2 of the disclosure.
Figure 11:
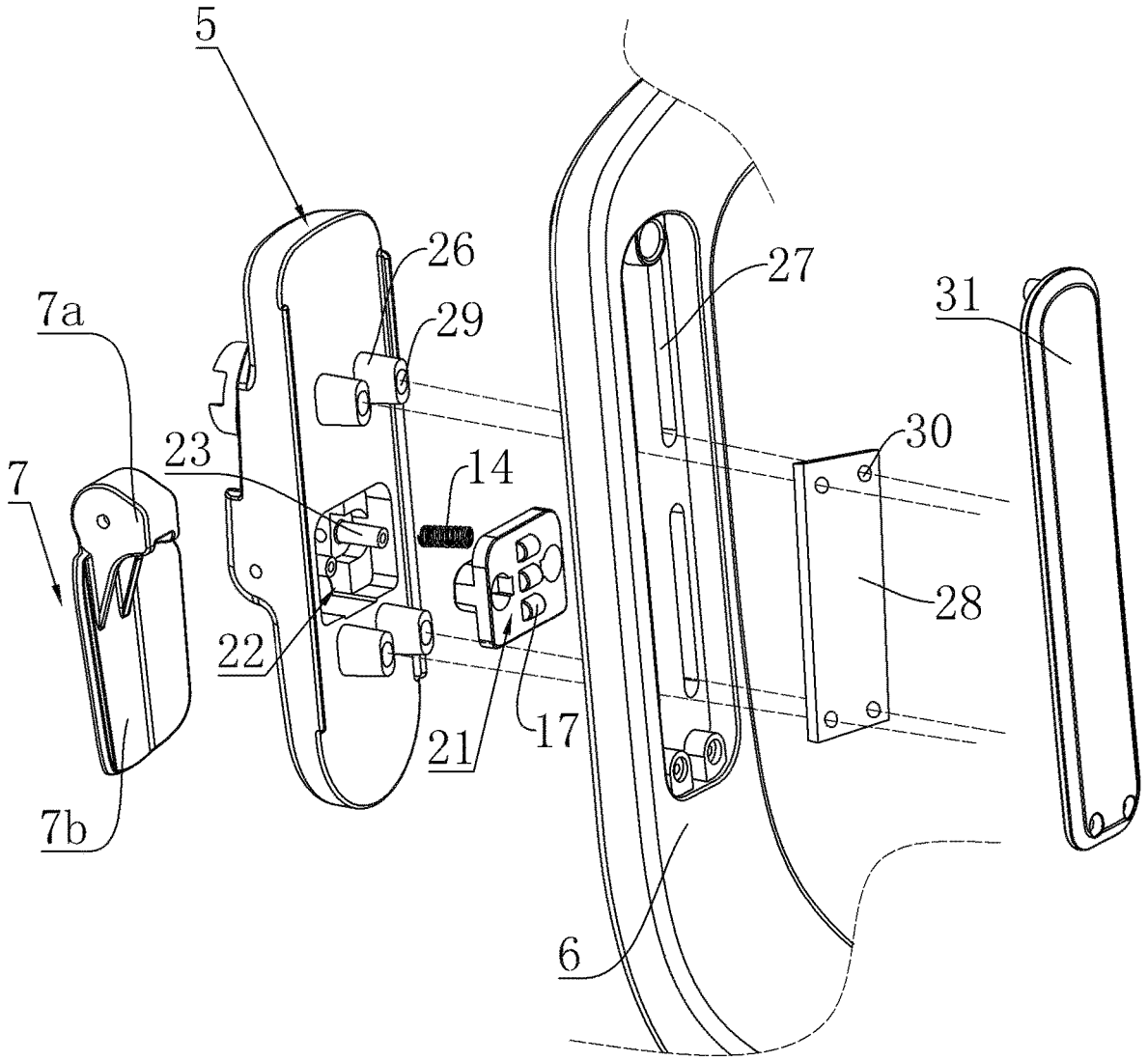
FIG. 11 is a schematic view of a three-dimensional structure of the connection base slidably connected to the support rod according to Embodiment 3 of the disclosure.

As shown in FIG. 9 to FIG. 11, an inner side of the connection base 5 close to the support rod 6 is provided with a movable groove 22, and a shape of the movable groove 22 is matched with a shape of the locking plate 21. The locking plate 21 is movably connected into the movable groove 22, and the movable groove 22 communicates with the rotation installation groove 13. The movable groove 22 is provided with two symmetrical connection pins 23. A pair of protruding blocks are correspondingly disposed on the locking plate 21, and the protruding blocks 24 are provided with guide holes 25 penetrating through the locking plate 21. When connection is performed, the connection pins 23 are inserted in the guide holes 25. In this way, the locking plate 21 may move in a length direction of the connection pins 23, and the locking plate 21 and the connection base 5 are allowed to be relatively fixed in a vertical direction. As such, when the connection base 5 is lifted or lowered, the locking plate 21 may be synchronously lifted or lowered together with the connection base 5.

Further, an end surface of the locking plate 21 facing the support rod 6 is provided with three engagement teeth 17 which are arranged at intervals in the longitudinal direction, and the engagement teeth 17 protrude from the end surface of the locking plate 21. One side of the support rod 6 facing the connection base 5 is correspondingly provided with a plurality of engagement grooves 18, and the engagement grooves 18 are longitudinally arranged on the support rod 6 at intervals in a wave-like shape. The engagement teeth 17 may be engaged and matched with the engagement grooves 18. As such, when the locking plate 21 and the support rod 6 are close together, the engagement teeth 17 are engaged with the engagement grooves 18, and the connection base 5 and the support rod 6 are relatively fixed. When the locking plate 21 is separated from the support rod 6, the engagement teeth 17 are separated from the engagement grooves 18, and the connection base 5 is slidable up and down relative to the support rod 6 to adjust the height of the armrest 4. That is, locking and unlocking of the connection base 5 may be achieved through control of movement of the locking plate 21. Further, elastic elements are provided between the locking plate 21 and the movable groove 22. The elastic elements are springs 14, and the springs 14 are sleeved on the connection pins 23. One end of each of the springs 14 is connected to an inner wall of the movable groove 22, and the other ends of the springs 14 are connected to the protruding blocks 24 of the locking plate 21. When the locking plate 21 and the support rod 6 are attached, the springs 14 are stretched, and an elastic force provided by the springs 14 allows the locking plate 21 to be inclined to move away from the support rod 6.

In this way, after the cam wrench 7 is rotatably connected into the rotation installation groove 13 on the connection base 5, since the rotation connection groove 13 communicates with the movable groove 22, the cam 7*a* on the cam wrench 7 may directly abut against and act on the locking plate 21. As such, the locking plate 21 may be directly pushed to move towards the support rod 6 through rotating the cam wrench 7 to control the engagement teeth 17 to be engaged with the engagement grooves 18. Sliding between the connection base 5 and the support rod 6 may thus be accordingly controlled to be locked or unlocked. In the locked state, the handle 7*b* covers on the connection base 5, the cam 7*a* presses and acts on the locking plate 21 so that the locking plate 21 is engaged with and fixed to the support rod 6. When sliding is required to be unlocked, the handle 7*b* is required to be flipped outwards only. The locking plate 21 moves away from the support rod 6 under an elastic force of the springs 14, so that the engagement teeth 17 are separated from the engagement grooves 18. The connection base 5 may thereby slide up and down relative to the support rod 6 to adjust the height of the armrest 4. After adjustment is completed, the handle 7*b* is rotated downwards, the cam wrench 7 presses the locking plate 21 again so that the locking plate 21 is engaged and matched with the support rod 6, and the connection base 5 is kept to be relatively fixed to the support rod 6 again. Movement of the locking plate 21 is controlled through rotating the cam wrench 7, so sliding between the connection base 5 and the support rod 6 may be controlled to be locked or unlocked, and such a structure is simple and reliable, is cost-saving, and is convenient to manipulate.

Embodiment 3. As shown in FIG. 11, a difference between this embodiment and Embodiment 1 is that, the connection base 5 and the support rod 6 are rotatably connected in a different manner. Further, a locking mechanism adopted in this embodiment is the locking mechanism shown in Embodiment 2. To be specific, a sliding mechanism is disposed between the connection base 5 and the support rod 6. The sliding mechanism includes a plurality of guide posts 26 disposed on an inner side of the connection base 5 and a plurality of guide grooves 27 correspondingly disposed on the support rod 6 in the longitudinal direction. A pair of guide posts 26 are provided on the upper and lower sides of the connection base 5, and correspondingly, four guide grooves 27 are disposed on the support rod 6. During installation, the connection base 5 is connected to the left and right sides of the support rod 6, and the guide posts 26 are inserted in the guide grooves 27 and may move up and down along the guide grooves 27. In this way, sliding and matching between the connection base 5 and the support rod 6 are achieved. Further, as the guide posts 26 slidably matched with the guide grooves 27 are provided, the connection base 5 may stably slide relative to the support rod 6, and gaps and oscillation are thus effectively eliminated.

Besides, after the connection base 5 slides and is matched with the support rod 6, one side of the support rod 6 away from the connection base 5, that is, the inner side of the support rod 6, is provided with a connection plate 28. End surfaces of the four guide posts 26 are provided with threaded holes 29, and four through holes 30 are correspondingly disposed on the connection plate 28. After the guide posts 26 are inserted in the guide grooves 27, the connection plate 28 is connected and fixed to the four guide posts 26 through bolts. After the connection plate 28 and the guide posts 26 are connected, the support rod 6 is clamped between the connection base 5 and the connection plate 28. The connection plate 28 is able to effectively restrict the guide posts 26 from being separated from the guide grooves 27, so that the connection base 5 and the support rod 6 are securely connected. Finally, a cover plate 31 is connected to the inner side of the support rod 6, and the cover plate 31 is connected to the support rod 6 through screws. The cover plate 31 is able to cover both the connection plate 28 and the guide grooves 27 on the support rod 6, so traces of connection are eliminated. Further, after the cover plate 31 is connected, the connection between the cover plate 31 and the support rod 6 is smooth, so that a surface of the support rod 6 is compact and appealing.

Figure 12:
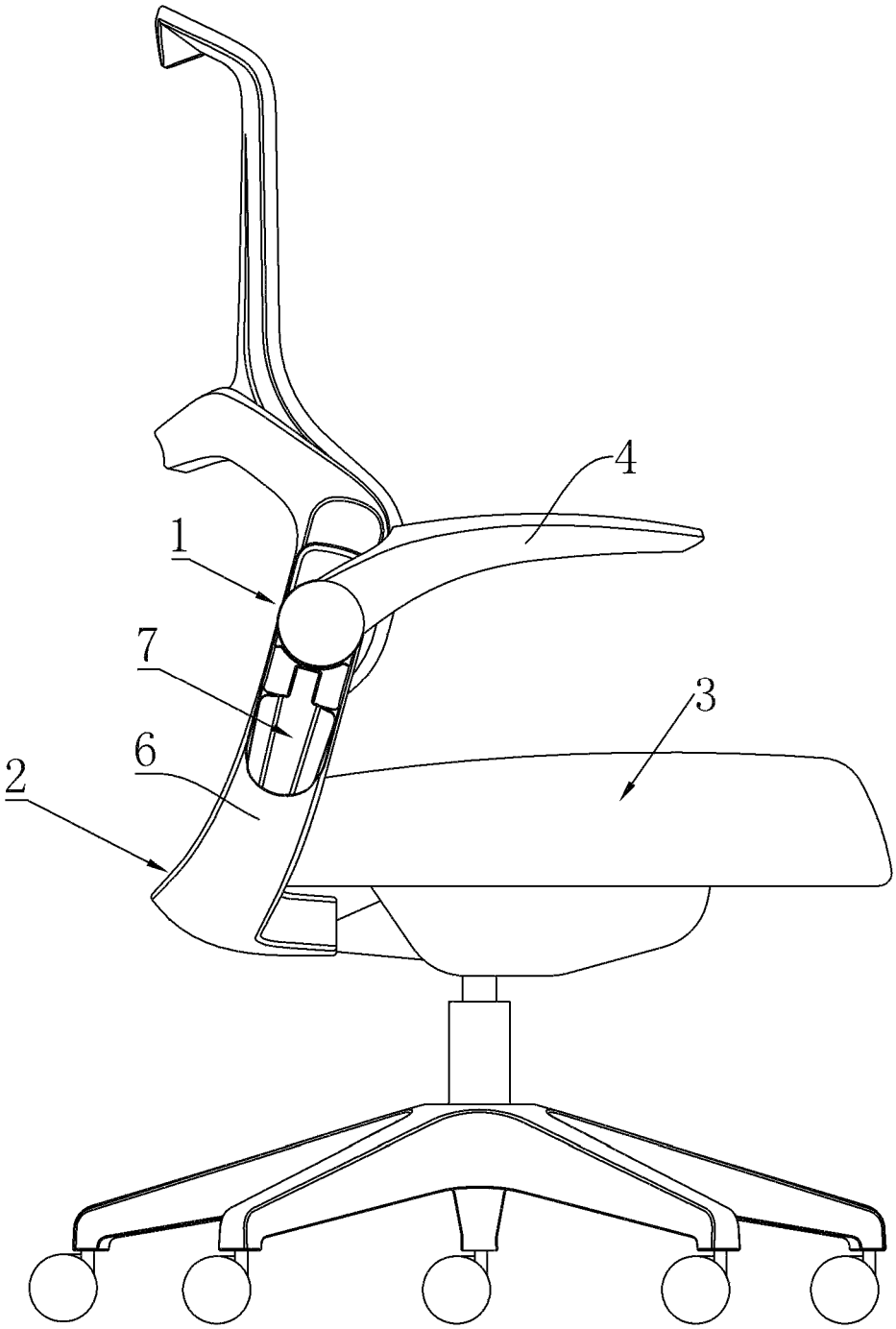
FIG. 12 is a schematic view of a three-dimensional structure of a cam adjustment device applied to a chair according to the disclosure.

The disclosure accordingly provides a chair. As shown in FIG. 12, the chair includes the chair seat 3 and the cam adjustment device for lifting and lowering the armrest, and the support frame 2 is connected and fixed to the chair seat 3.

In view of the foregoing, through the foregoing structure, lifting, lowering, and adjustment of the armrest are achieved. Compared to the structure for armrest lifting and lowering currently available on the market, the structure provided by the disclosure is simple and requires less components. The connection structure between the connection base 5 and the support rod 6 is simple and may be easily installed, so that manufacturing and processing costs of the armrest are reduced. Further, sliding between the connection base 5 and the support rod 6 may be controlled to be locked or unlocked through control of rotation of the cam wrench 7. It thus can be seen that a practically-designed structure which is convenient to manipulate is provided because rotating of the cam wrench 7 is the only action required to be performed.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A cam adjustment device for lifting and lowering an armrest, comprising an armrest assembly and a support frame configured to support the armrest assembly, wherein the armrest assembly comprises a connection base, the support frame has a support rod arranged in a longitudinal direction, the connection base is slidably connected to the support rod, a locking mechanism is provided between the connection base and the support rod, the locking mechanism comprises a cam wrench disposed on the connection base, the cam wrench is rotatably installed on the connection base, the cam wrench is rotated such that a cam on the cam wrench directly or indirectly presses and acts on the support rod, the armrest assembly has a locked state and an unlocked state, in the locked state, the cam wrench presses and acts on the support rod such that the connection base and the support rod are kept to be relatively fixed, and in the unlocked state, the cam wrench is rotated to allow the cam to be released from the support rod, such that the connection base is lifted, lowered, and adjusted relative to the support rod, the locking mechanism further comprises an elastic engagement member connected to the connection base, the elastic engagement member has an engagement head clamped between the connection base and the support rod, the engagement head is able to be engaged and matched with the support rod, in the locked state, the cam wrench presses the engagement head such that the engagement head is engaged with the support rod, and in the unlocked state, the cam wrench is rotated such that the elastic engagement member resets and the engagement head is separated from the support rod, an elastic reset device is further provided between the connection base and the elastic engagement member, the elastic reset device comprises a spring, one end of the spring is connected to the connection base, the other end of the spring is connected to the elastic engagement member, and the spring is elastically deformed to provide an elastic force for the elastic engagement member to reset when the cam wrench presses the engagement head such that the engagement head is engaged and matched with the support rod.

2. The cam adjustment device for lifting and lowering the armrest according to claim 1, wherein a rotation installation groove penetrating in a left-right direction is provided on the connection base, the cam on the cam wrench is rotatably connected into the rotation installation groove, a handle on the cam wrench is exposed outside the connection base, in the locked state, the cam wrench downwardly covers the connection base, and in the unlocked state, the cam wrench is flipped outwards to be unfolded around the connection base.

3. The cam adjustment device for lifting and lowering the armrest according to claim 2, wherein the elastic engagement member has a long strip shape, the engagement head is located on an upper end of the elastic engagement member, a lower end of the elastic engagement member is fixed and connected to one side of the connection base away from the support rod, the engagement head is inserted in the rotation installation groove, and the cam wrench is rotated to abut against and act on the engagement head.

4. The cam adjustment device for lifting and lowering the armrest according to claim 2, wherein engagement teeth and engagement grooves engaged and matched with each other are provided between the engagement head and the support rod, the engagement teeth are disposed on the engagement head in the longitudinal direction, and the engagement grooves are arranged on the support rod at intervals in a wavy shape in the longitudinal direction.

5. The cam adjustment device for lifting and lowering the armrest according to claim 1, wherein an outwardly protruding sliding base is provided on the support rod, the sliding base is slidably matched with the connection base, a sliding guide mechanism is provided between the sliding base and the connection base, the sliding guide mechanism comprises a sliding path and a sliding rail, the sliding path is disposed on one of the sliding base and the connection base, and the sliding rail is correspondingly disposed on the other one of the sliding base and the connection base.

6. The cam adjustment device for lifting and lowering the armrest according to claim 5, wherein in a width direction of the sliding base, two sides of the sliding base are recessed inwards to form the sliding path arranged in a length direction of the support rod, two sides of the connection base close to the sliding base respectively extend towards a middle portion of the connection base to form the sliding rail arranged in a length direction of the connection base, and the sliding path is matched with the sliding rail to limit the connection base to only slide in the length direction of the support rod.

7. A chair, comprising a chair seat and the cam adjustment device for lifting and lowering the armrest according to claim 1, wherein the support frame is installed on the chair seat.

* * * * *